US010914514B1

(12) United States Patent
Hunter et al.

(10) Patent No.: US 10,914,514 B1
(45) Date of Patent: Feb. 9, 2021

(54) ILLUMINATED TRIM ASSEMBLY FOR APPLIANCE

(71) Applicant: WHIRLPOOL CORPORATION, Benton Harbor, MI (US)

(72) Inventors: Lynne F. Hunter, Dorr, MI (US); Narendra A. Kapure, Pune (IN); Abhay Naik, Stevensville, MI (US); Manjunathraddi Navalgund, Pune (IN); Sanjesh Kumar Pathak, Stevensville, MI (US); Sanket V. Phalak, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/746,240

(22) Filed: Jan. 17, 2020

(51) Int. Cl.
*F25D 27/00* (2006.01)
*F25D 23/08* (2006.01)
*F25D 23/06* (2006.01)

(52) U.S. Cl.
CPC ..... *F25D 27/00* (2013.01); *F25D 23/066* (2013.01); *F25D 23/085* (2013.01); *F25D 2327/00* (2013.01)

(58) Field of Classification Search
CPC ..... F25D 27/00; F25D 23/066; F25D 23/085
USPC ..... 362/92
See application file for complete search history.

(56) References Cited

U.S. PATENT DOCUMENTS 2,002,366 A * 5/1935 Eto ..... F25D 23/066 220/614
2,254,604 A * 9/1941 Forsthoefel ..... F25D 23/062 62/448
2,995,649 A 8/1961 Cyrus
3,612,848 A 10/1971 Koch et al.
3,633,783 A 1/1972 Aue
4,142,092 A 2/1979 Abrams
4,918,579 A * 4/1990 Bennett ..... F25D 27/00 108/23
5,937,666 A * 8/1999 Trulaske, Sr. ..... A47F 3/001 362/125
6,178,763 B1 1/2001 Brancheau et al.
6,210,013 B1 4/2001 Bousfield
6,406,108 B1 * 6/2002 Upton ..... A47F 3/001 312/116
6,485,122 B2 11/2002 Wolf et al.
6,655,766 B2 12/2003 Hodges
6,726,341 B2 4/2004 Pashley et al.
(Continued)

FOREIGN PATENT DOCUMENTS

WO 2018080472 A1 3/2018

*Primary Examiner* — Bryon T Gyllstrom
(74) *Attorney, Agent, or Firm* — Price Heneveld LLP

(57) ABSTRACT

An appliance has an illuminated trim assembly that includes an appliance cabinet having first and second sidewalls and a top wall. The appliance cabinet defines a compartment. A trim breaker member extends along a forward edge of the first and second sidewalls and the top wall. A light housing is positioned rearward of the trim breaker member and defines a light source channel. The light source channel has an open end proximate the compartment. A lens extends between the trim breaker member and the light housing. The lens is positioned to separate the light source channel from the compartment. A light source is positioned within the light source channel and is configured to direct light through the lens into the compartment.

20 Claims, 7 Drawing Sheets

(56) References Cited

U.S. PATENT DOCUMENTS

| | | | | |
|---|---|---|---|---|
| 7,559,672 | B1 | 7/2009 | Parkyn et al. | |
| 8,128,251 | B2 * | 3/2012 | Huang | A47F 3/001 362/126 |
| 8,388,171 | B2 | 3/2013 | Tung et al. | |
| 8,899,070 | B2 | 12/2014 | Eckartsberg et al. | |
| 9,879,900 | B1 | 1/2018 | Ammerman et al. | |
| 2008/0315735 | A1 * | 12/2008 | Fabbro | F25D 25/00 312/223.6 |
| 2009/0244884 | A1 * | 10/2009 | Trulaske, Sr. | A47F 3/043 362/94 |
| 2010/0014288 | A1 | 1/2010 | Kreutzer et al. | |
| 2010/0254116 | A1 | 10/2010 | Lee | |
| 2011/0058353 | A1 * | 3/2011 | Yang | F21S 8/02 362/84 |
| 2011/0235307 | A1 * | 9/2011 | Hernandez | A47F 3/001 362/92 |
| 2014/0216706 | A1 | 8/2014 | Melton et al. | |
| 2016/0290708 | A1 * | 10/2016 | Bassan | B29C 48/0022 |
| 2019/0120547 | A1 * | 4/2019 | Staud | F25D 23/028 |
| 2019/0310011 | A1 * | 10/2019 | Marinello | F25D 23/066 |

* cited by examiner

II

ILLUMINATED TRIM ASSEMBLY FOR APPLIANCE

FIELD OF DISCLOSURE

The present disclosure generally relates to a trim assembly, and more specifically, to an illuminated trim assembly for an appliance.

BACKGROUND

Refrigerator appliances generally include various light sources configured to illuminate a cavity of the appliance. These light sources may be positioned in various locations within the cavity of the appliance.

SUMMARY OF THE DISCLOSURE

According to one aspect of the present disclosure, a trim assembly for an appliance includes a cabinet having first and second opposing sidewalls and a top wall. The cabinet defines a compartment. A trim breaker member extends continuously along a forward edge of the first and second opposing sidewalls and the top wall. A light housing is positioned rearward of the trim breaker member. The light housing defines a first channel. A lens extends between the trim breaker member and the light housing. The lens is positioned at least partially within the compartment. A light source is positioned within the first channel and is configured to direct light through the lens into the compartment. A heat loop assembly is operably coupled with the trim breaker member. The heat loop assembly includes a cover operably coupled with the trim breaker member and at least partially defining a second channel. A heat loop is positioned within the second channel and is supported by the cover.

According to yet another aspect of the present disclosure, a trim assembly for an appliance includes a trim breaker member extending continuously along a forward edge of first and second opposing sidewalls and a top wall of an appliance cabinet. A light housing is positioned rearward of the trim breaker member. The light housing defines a light source channel. A lens extends between the trim breaker member and the light housing. A light source is positioned within the light source channel. The lens is configured to direct light into a cavity defined by the appliance cabinet.

According to another aspect of the present disclosure, an appliance has an illuminated trim assembly that includes an appliance cabinet having first and second sidewalls and a top wall. The appliance cabinet defines a compartment. A trim breaker member extends along a forward edge of the first and second sidewalls and the top wall. A light housing is positioned rearward of the trim breaker member and defines a light source channel. The light source channel has an open end proximate the compartment. A lens extends between the trim breaker member and the light housing. The lens is positioned to separate the light source channel from the compartment. A light source is positioned within the light source channel and is configured to direct light through the lens into the compartment.

These and other features, advantages, and objects of the present disclosure will be further understood and appreciated by those skilled in the art by reference to the following specification, claims, and appended drawings.

Figure 1:
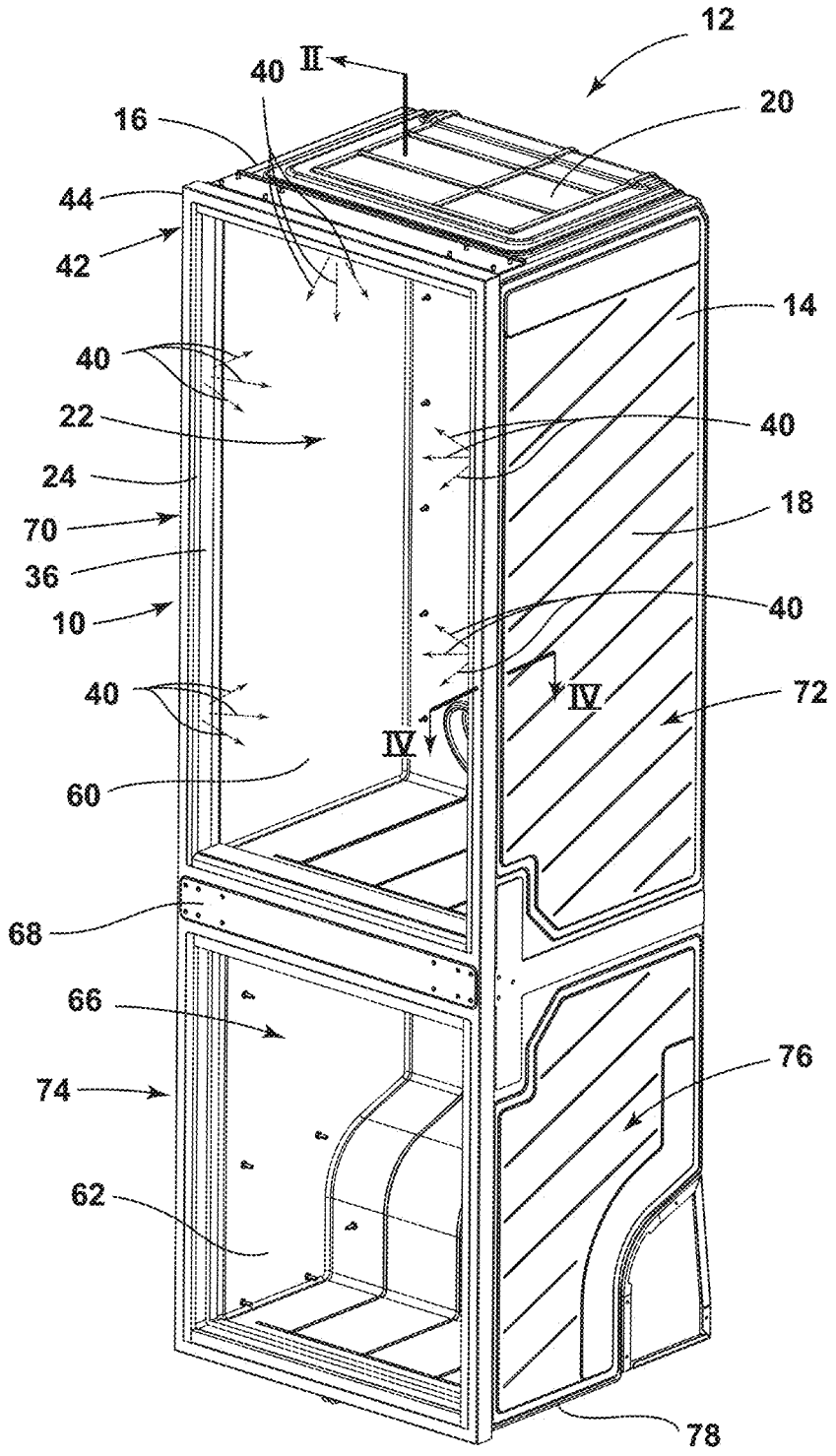
FIG. 1 is a side perspective view of a cabinet of a refrigerator appliance having a trim assembly, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to a trim assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally designates a trim assembly for an appliance 12. The trim assembly 10 is coupled with an appliance cabinet 14 having first and second opposing sidewalls 16, 18 and a top wall 20. The cabinet 14 defines a compartment 22. A trim breaker member 24 extends continuously along a forward edge 26, 28, 30 of the first and second opposing sidewalls 16, 18 and the top wall 20. A light housing 32 is positioned rearward of the trim breaker member 24. The light housing 32 defines a light source channel 34. A lens 36 extends between the trim breaker member 24 and the light housing 32. The lens 36 is positioned at least partially within the compartment 22 of the cabinet 14. A light source 38 is positioned within the light source channel 34 and is configured to direct light 40 through the lens 36 into the compartment 22 of the cabinet 14. A heat loop assembly 42 is operably coupled with the trim breaker member 24. The heat loop assembly 42 includes a heat loop cover 44 operably coupled with the trim breaker member 24. The heat loop cover 44 at least partially defines a heat loop receiving channel 46. A heat loop 48 is positioned within the heat loop receiving channel 46 and is supported by the heat loop cover 44.

Referring again to FIGS. 1 and 2, the cabinet 14 of an appliance 12 is illustrated without a wrapper. The cabinet 14 includes a refrigerator compartment liner 60 and a freezer compartment liner 62. The refrigerator compartment liner 60 and the freezer compartment liner 62 are in a spaced-apart configuration forming the refrigerator compartment 22 and a freezer compartment 66. The first and second sidewalls 16, 18 are joined by the top wall 20 proximate the refrigerator compartment 22. A mullion 68 is disposed between the refrigerator compartment liner 60 and the freezer compartment liner 62. The mullion 68 separates each of the first and second sidewalls 16, 18 into an upper portion 70, 72 and a lower portion 74, 76. A bottom wall 78 extends between the lower portions 74, 76 of the first and second sidewalls 16, 18 proximate the freezer compartment liner 62. As illustrated, according to one embodiment, the freezer compartment 66 is arranged in a bottom-mount configuration relative to the refrigerator compartment 22. Although the freezer compartment 66 is shown as the "bottom freezer" type, the teachings set forth herein are applicable to other types of cooling appliances, including but not limited to, side-by-side refrigerator/freezers, top-mount freezers, etc. Accordingly, embodiments of the present disclosure are therefore not intended to be limited to any particular type and/or configuration of the refrigeration appliance 12.

Each of the first and second sidewalls 16, 18, the top wall 20, and the bottom wall 78 include a forward edge 26, 28, 30, 80. The trim assembly 10 is operably coupled with the forward edges 26, 28, 30, 80 of the first and second sidewalls 16, 18, the top wall 20, and the bottom wall 78 and may further be operably coupled with one or both of the refrigerator compartment liner 60 and the freezer compartment liner 62. As illustrated, the trim assembly 10 is an illuminated trim assembly proximate the refrigerator compartment liner 60 and includes the lens 36 operably coupled with the trim breaker member 24 and the light housing 32. However, it is contemplated that the trim assembly 10 may be an illuminated trim assembly, as described herein, along any portion of the refrigerator appliance 12 without departing from the scope of the present disclosure.

Figure 2:
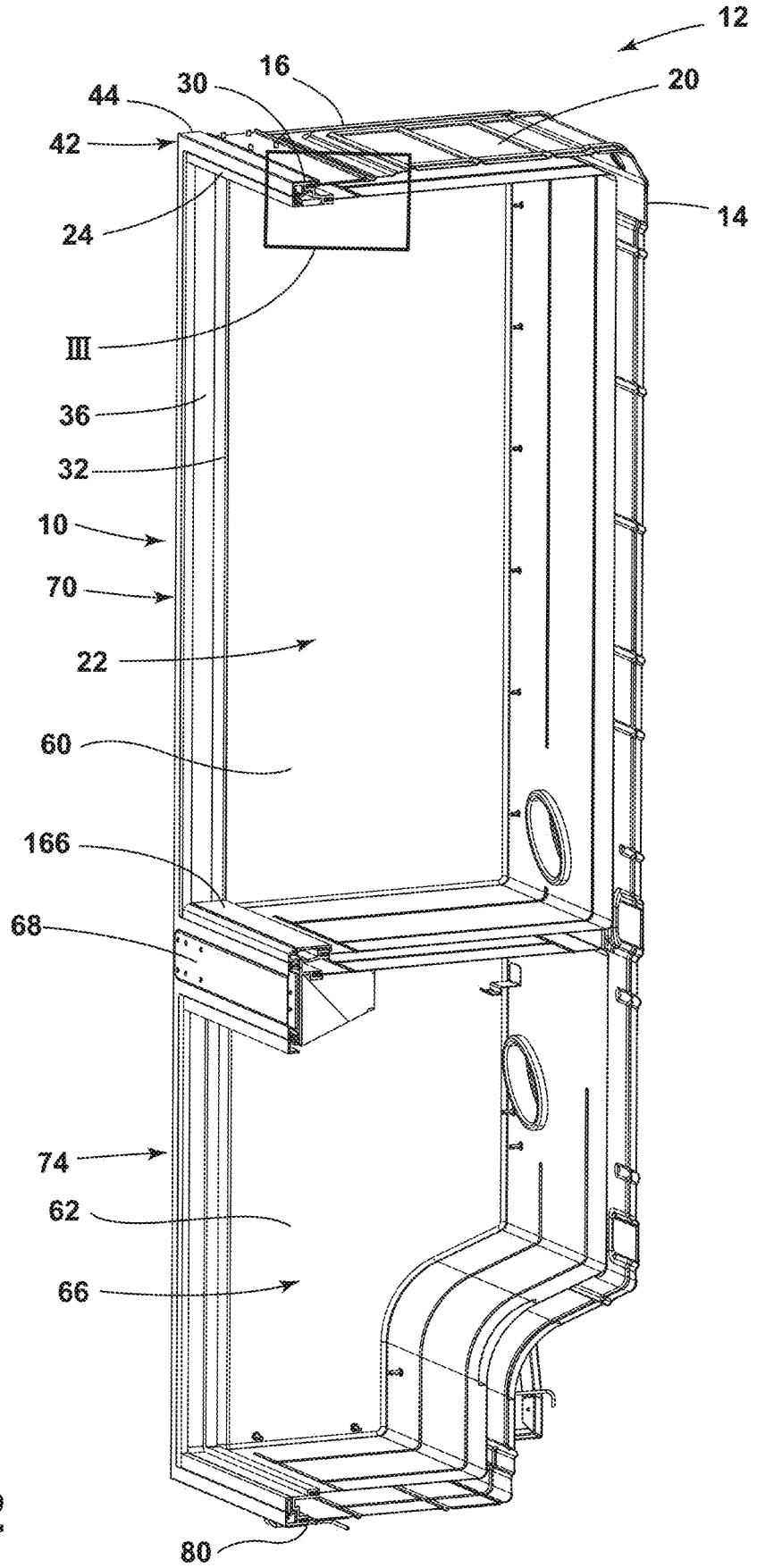
FIG. 2 is a cross-sectional view of the cabinet of FIG. 1 taken along line I-I.

Referring still to FIGS. 1 and 2, the illuminated trim assembly 10 is positioned proximate the refrigerator compartment liner 60 and extends along the upper portions 70, 72 of the first and second sidewalls 16, 18 and the top wall 20 of the cabinet 14. The illuminated trim assembly 10 is operably coupled with the forward edge 26, 28, 30 of each of the first and second sidewalls 16, 18 and the top wall 20. As illustrated, the trim assembly 10 may be configured such that the trim assembly 10 proximate the mullion 68 does not illuminate. However, it is contemplated that the trim assembly 10 may illuminate the entire perimeter of the refrigerator compartment 22 or only a portion of the perimeter of the refrigerator compartment 22 without departing from the scope of the present disclosure.

Figure 3:
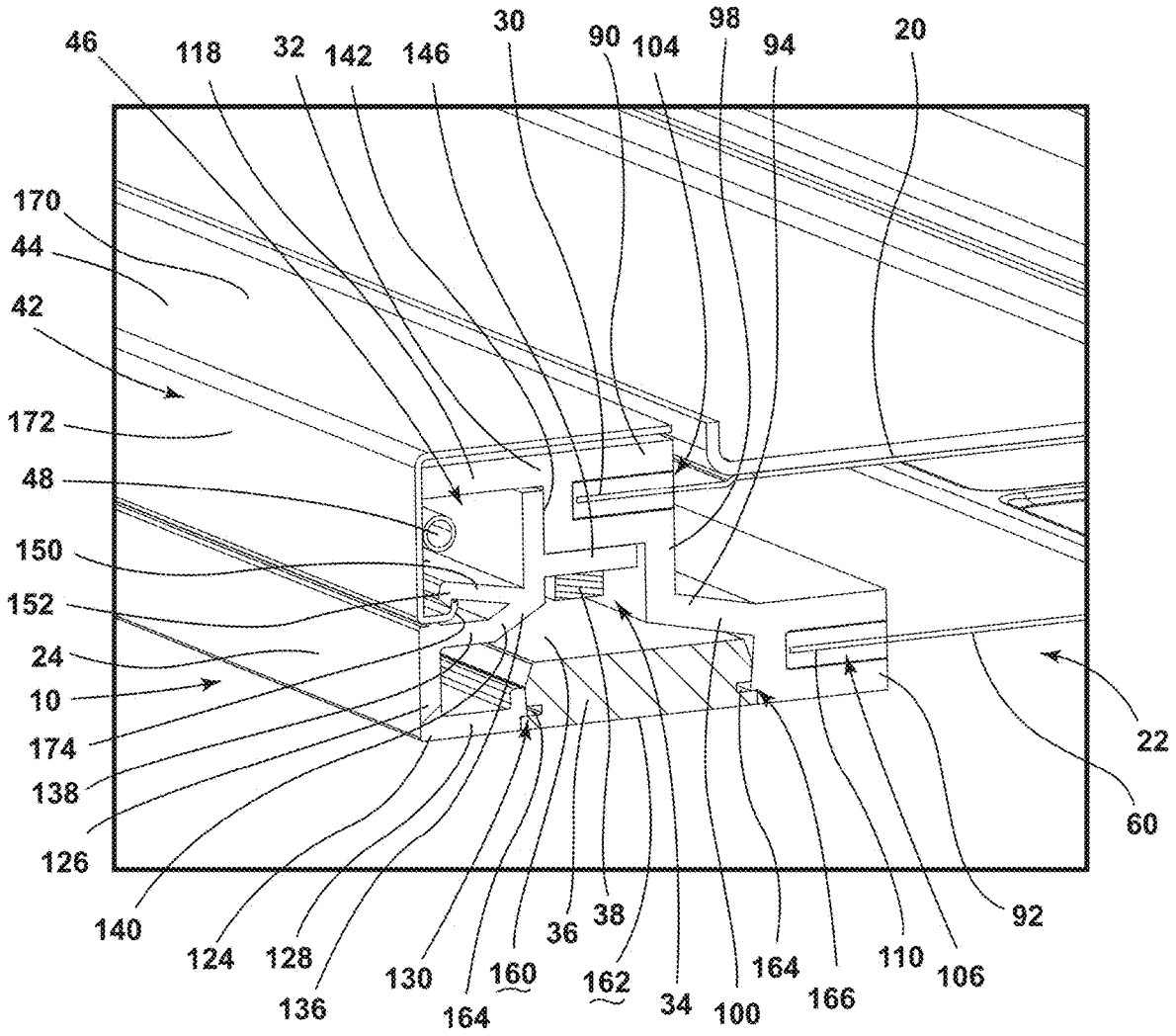
FIG. 3 is an enlarged view of section III of FIG. 2 illustrating a portion of the trim assembly, according to various examples.

Referring now to FIG. 3, a cross-section of the illuminated trim assembly 10 is illustrated proximate the top wall 20 of the cabinet 14. As previously introduced, the trim assembly 10 includes the light housing 32. The light housing 32 includes a first receiving portion 90 and a second receiving portion 92. The first and second receiving portions 90, 92 are integrally formed with, and joined by, a body 94 of the light housing 32. The body 94 includes a first leg 98 integrally formed with the first receiving portion 90 and a second leg 100 integrally formed with the second receiving portion 92. The first leg 98 extends downward from the first receiving portion 90 and may be positioned substantially perpendicular to the first receiving portion 90. The second leg 100 extends upward at an incline from the second receiving portion 92 to meet the first leg 98 of the body 94. The first leg 98 of the body 94 and the first receiving portion 90 may at least partially define the light source channel 34, as discussed in more detail elsewhere herein.

The first receiving portion 90 defines a first receiving space 104 that opens rearward and is configured to receive the forward edge 30 of the top wall 20. In various examples, the first receiving space 104 may include a material or adhesive configured to retain and or cushion the forward edge 30 of the top wall 20. The second receiving portion 92 defines a second receiving space 106 that opens rearward and is configured to receive an edge 110 of the refrigerator compartment liner 60. In various examples, the second receiving space 106 may include a material or adhesive configured to retain and/or cushion the forward edge of the refrigerator compartment liner 60.

As illustrated in FIG. 3, a first coupling feature 116 is defined by the second receiving portion 92. The first coupling feature 116 may be positioned forward of the second receiving space 106 and is configured to couple the lens 36 with the light housing 32. The first coupling feature 116 may be a clip, receiving space, or any other coupling feature configured to couple with a side of the lens 36 to retain the lens 36 without departing from the scope of the present disclosure.

A forward extension 118 protrudes forwardly from the first receiving portion 90 and away from the cabinet 14. The forward extension 118 is integrally formed with the first receiving portion 90 and is positioned substantially perpendicular to the first leg 98 of the body 94 of the light housing 32. The forward extension 118 may be configured to at least partially define the heat loop receiving channel 46, as discussed in more detail elsewhere herein.

Referring still to FIG. 3, the trim breaker member 24 is operably coupled with the light housing 32. The trim breaker member 24 includes an outer portion 124 having a first side 126 and a second side 128. When the trim assembly 10 is coupled with the cabinet 14, the first side 126 of the outer portion 124 is exposed forward of the cabinet 14 and the second side 128 is positioned within the cabinet 14 and substantially aligned with the refrigeration compartment liner 60.

The second side 128 defines a second coupling feature 130 configured to couple the lens 36 with the trim breaker member 24. When the trim assembly 10 is assembled, the second coupling feature 130 is positioned opposite of and aligned with the first coupling feature 116 of the light housing 32. The second coupling feature 130 may be a clip, receiving space, or any other coupling feature configured to couple with a side of the lens 36 to retain the lens 36 without departing from the scope of the present disclosure.

A body 136 is integrally formed with, and extends from, the outer portion 124 of the trim breaker member 24. The body 136 may have a horizontal section 138 that extends perpendicular to the first side 126 of the outer portion 124. An inclined section 140 extends between the horizontal section 138 and a vertical section 142 of the body 136. The vertical section 142 extends upward from the inclined section 140. The sections 138, 140, 142 of the body 136 may be integrally formed as a single piece or may be formed as multiple pieces and coupled together.

A support 146 extends perpendicular to the vertical section 142 of the body 136 of the trim breaker member 24. The vertical section 142 and the support 146 are positioned to abut and at least partially wrap around the first receiving portion 90 of the light housing 32 when the trim breaker member 24 is coupled with the light housing 32. Further, when the trim breaker member 24 is coupled with the light housing 32, the body 136 at least partially defines the heat loop receiving channel 46. For example, as illustrated, the body 136 of the trim breaker member 24 may act as two of three walls defining the heat loop receiving channel 46, and the forward extension 118 of the light housing 32 may act as the third wall defining the heat loop receiving channel 46. An open end of the heat loop receiving channel 46 is defined between the horizontal section 138 of the body 136 and the forward extension 118 of the light housing 32.

A retention arm 150 extends forwardly from the inclined section 140 proximate the vertical section 142 of the body 136 and into the heat loop receiving channel 46. The retention arm 150 may include a retention feature 152 defined at an end of the retention arm 150. The retention feature 152 is configured to engage with and retain the heat loop cover 44 of the heat loop assembly 42. For example, as illustrated, the retention feature 152 may have a generally hook-shaped cross-section to engage with the heat loop cover 44. However, it is contemplated that any retention feature 152 configured to engage with and retain the heat loop cover 44 may be used without departing from the scope of the present disclosure.

Referring still to FIG. 3, the light source 38 is positioned within the light source channel 34 and is operably coupled with the support 146 of the trim breaker member 24. In various examples, the light source 38 may be a plurality of light sources spaced apart along the support 146 of the trim breaker member 24 extending across the first and second sidewalls 16, 18 and the top wall 20 (FIGS. 1 and 2). In other examples, the light source 38 may be a single light source operably coupled with a light guide extending through the light source channel 34 across the first and second sidewalls 16, 18 and the top wall 20. Where a light guide is used, the light guide may be coupled with the support 146 of the trim breaker member 24. In still other examples, the trim breaker member 24 and the light housing 32 may be configured such that the light source channel 34 acts as a light guide for the light source 38 across at least the first and second sidewalls 16, 18 and the top wall 20. It is contemplated that the light source 38 may be positioned by the trim assembly 10 to illuminate up to the entire perimeter of the compartment 16 without departing from the scope of the present disclosure.

The light source channel 34 is generally defined between the trim breaker member 24 and the light housing 32. An open end of the light source channel 34 is defined between the second receiving portion 92 of the light housing 32 and the outer portion 124 of the trim breaker member 24. In assembly, the light source 38 is enclosed within the light source channel 34 by the lens 36. In other words, the lens 36 covers the open end of the light source channel 34 when the trim assembly 10 is assembled.

With continued reference to FIG. 3, the lens 36 is configured to allow light 40 to pass through the lens 36 into the compartment 16. For example, the lens 36 may be formed of transparent or translucent polymers, glass, or any other material configured to allow light to pass through. The lens includes a first surface 160 positioned within the light source channel 34 and a second surface 162 positioned within the compartment 22. The second surface 162 is substantially aligned with the second side 128 of the outer portion 124 of the trim assembly 10 and a surface of the second receiving portion 92 of the light housing 32. The lens 36 further includes side edges 164 configured to be received by and/or retained by the first and second coupling features 116, 130. For example, as illustrated, the first and second coupling features 116, 130 may be configured to receive the side edges 164.

When the lens 36 is coupled with the light housing 32 and the trim breaker member 24, the lens 36 is configured to direct light 40 from the light source 38 into the compartment 22 (FIG. 1). In various examples, the lens 36 may include optics configured to direct the light 40. In other examples, the lens 36 may be angled to direct the light 40 into the compartment 22 or the light source 38 may be positioned to direct the light 40 into the compartment 22.

Figure 4:
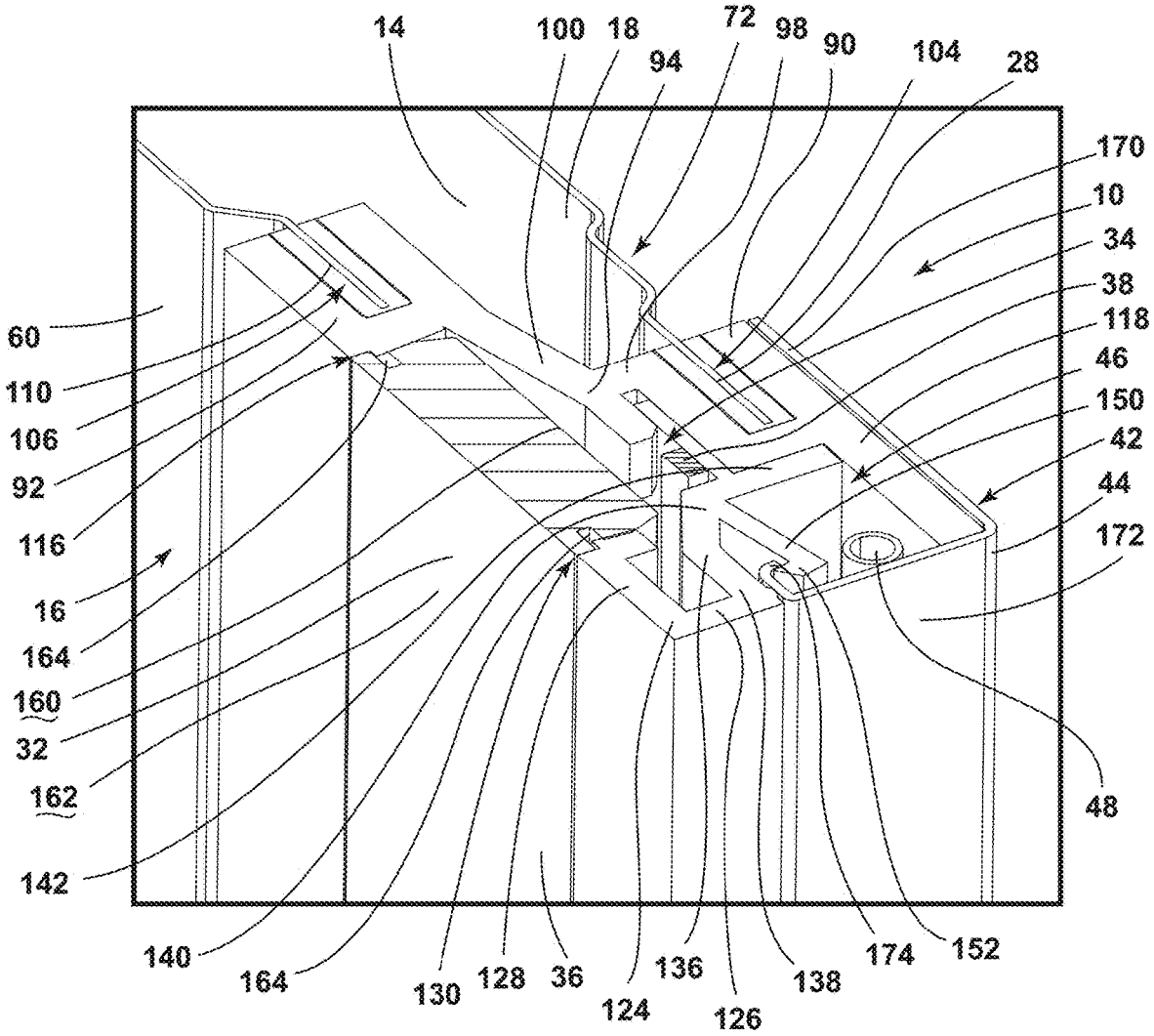
FIG. 4 is a cross-sectional view of a portion of the trim assembly of FIG. 1 taken along line IV-IV.
Figure 5:
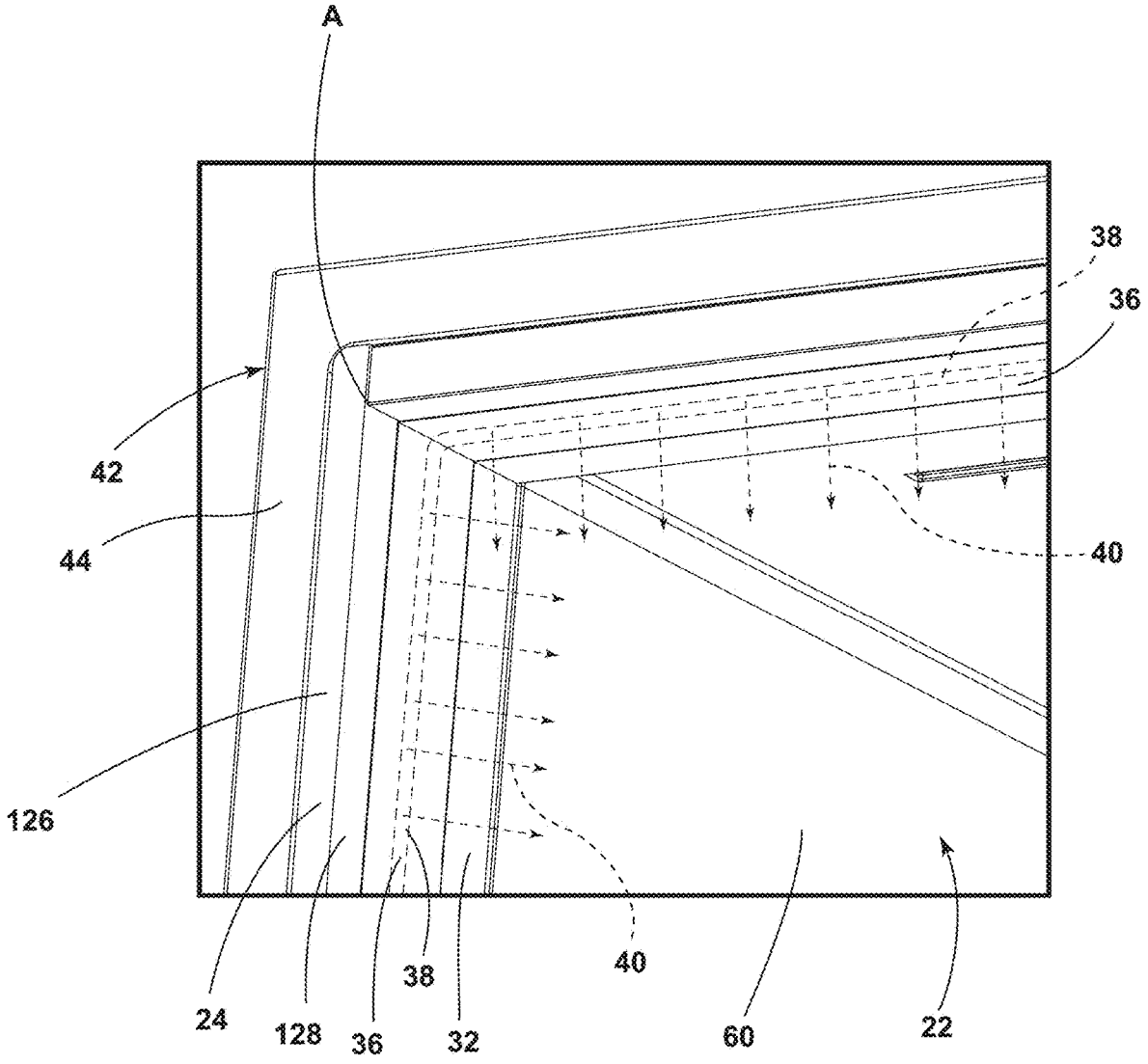
FIG. 5 is an enlarged perspective view of a top corner of the trim assembly of FIG. 1.

Referring now to FIG. 4, a cross-section of the illuminated trim assembly 10 is illustrated proximate the second sidewall 18. It will be understood that the trim assembly 10 has the same or similar components proximate each of the first and second sidewalls 16, 18 such that trim assembly 10 has the same or similar structure proximate the first sidewall 16 as the illustrated structure proximate the second sidewall 18. The trim assembly 10 includes the light housing 32 operably coupled with the edge 110 of the refrigerator compartment liner 60 and the forward edge 28 of the second sidewall 18. The light source 38 is coupled with the support 146 of the trim breaker member 24 and is configured to illuminate through the lens 36. The lens 36 is positioned to cover the open end of the light source channel 34 and is coupled with the trim breaker member 24 and the light housing 32. In various examples, as illustrated, the light housing 32 may be elongated to accommodate the size and shape of the sidewall 18. It will be understood that the components of the trim assembly 10 may be elongated in a forward/rearward direction or a side-to-side direction to accommodate the respective wall 16, 18, 20 and/or the size and shape of the appliance 12. It will further be understood that the pieces of the trim assembly 10 may be mirrored based on which sidewall 16, 18 the trim assembly 10 is coupled with (e.g., the left side of the trim assembly 10 is a mirror of the right side of the trim assembly 10).

Referring now to FIGS. 1-5, a corner A of the trim assembly 10 is illustrated at the first sidewall 16 and the top wall 20. The lens 36 of the trim assembly 10 and the light source 38 are continuous across the corner A, resulting in continuous illumination along the forward edges 26, 28, 30 of the walls 16, 18, 20 of the cabinet 14. Although it will be understood that the illumination is continuous, light rays 40 are illustrated to indicate that light eminates through the lens 36. Because there is no break in the lens 36, the corner A, and other corners spanned by the lens 36, the shadow often present at the corner A may be reduced or eliminated. Where the lens 36 is not continued (e.g., where the first and second sidewalls 16, 18 meet the mullion 68), a lower trim cover 166 may be used to create a continuous surface. The lower trim cover 166 may be opaque and may be configured to match the refrigerator compartment liner 60. It is further contemplated that the lens 36 and the light source 38 may extend along part of or all of the mullion 68 to illuminate upward and/or inward into the refrigerator compartment 22 without departing from the scope of the present disclosure.

Figure 6:
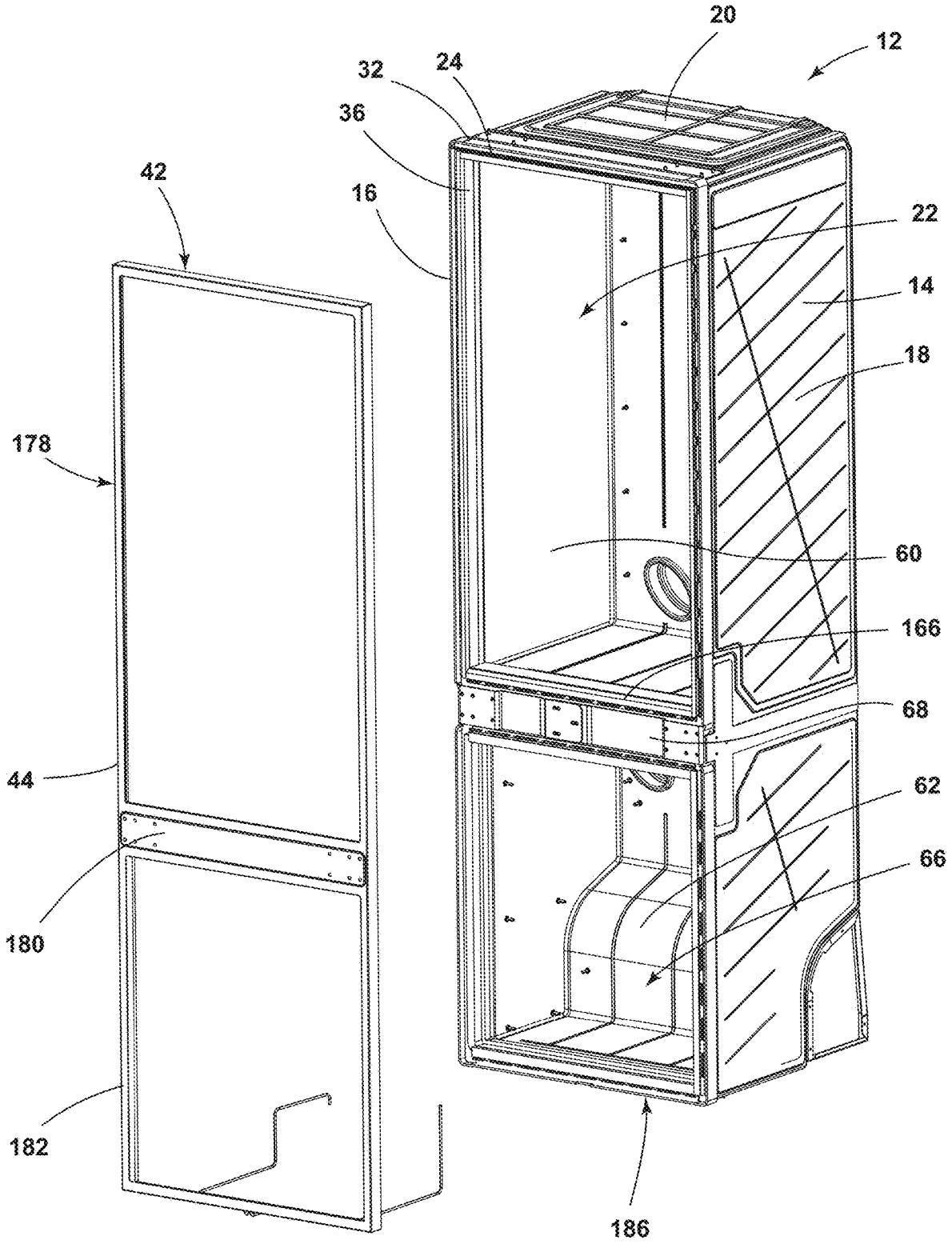
FIG. 6 is a side perspective view of the cabinet of FIG. 1 with a heat loop assembly separated from the trim assembly.
Figure 7:
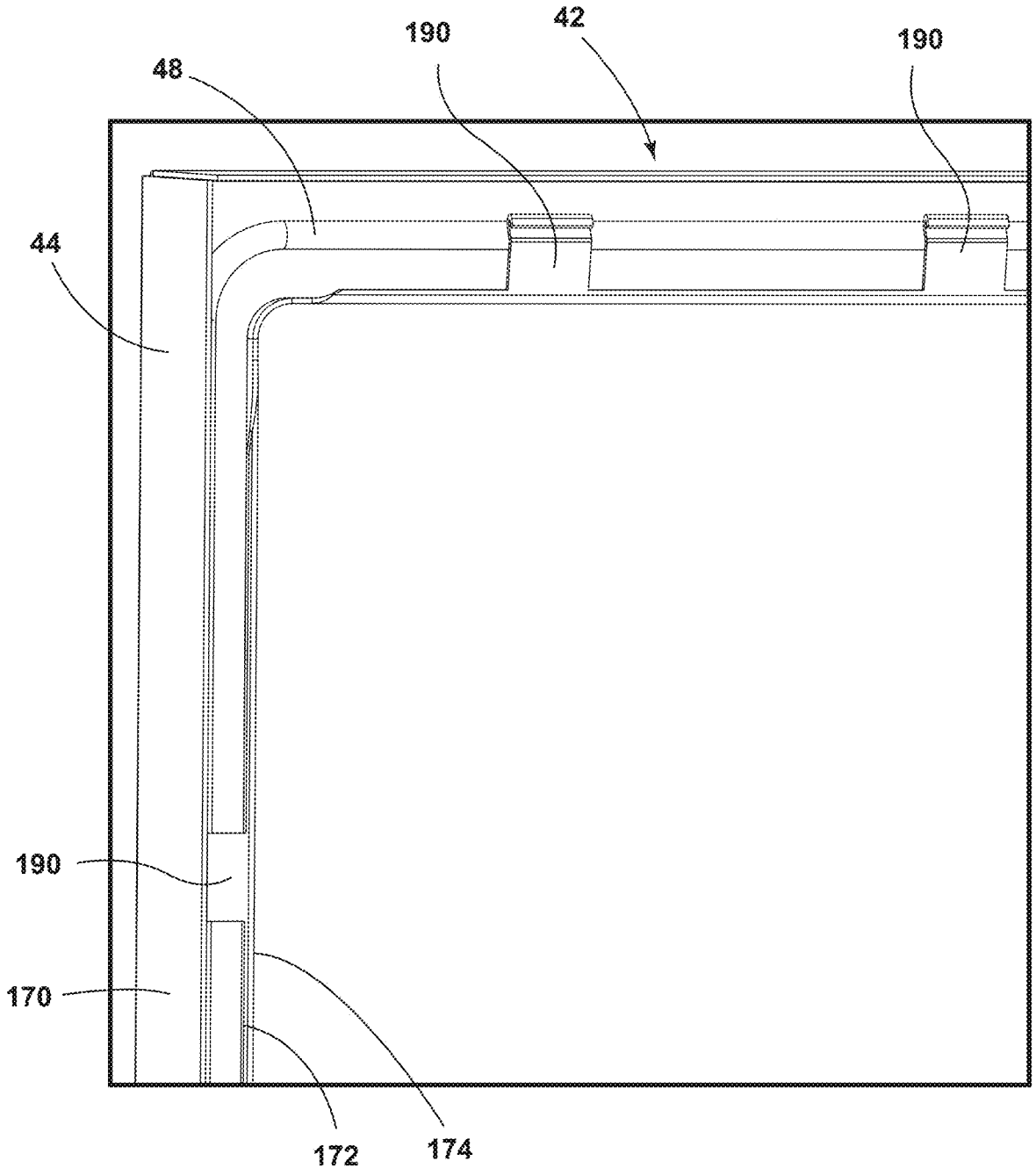
FIG. 7 is an enlarged rear view of the heat loop assembly of FIG. 6.

Referring now to FIG. 3-7, the heat loop assembly 42 is illustrated operably coupled with the trim assembly 10 (FIGS. 3-5) and separated from the trim assembly 10 (FIGS. 6 and 7). As introduced above, the heat loop assembly 42 includes the heat loop cover 44 configured to retain and conceal the heat loop 48.

In various examples, as illustrated in FIG. 6, the heat loop assembly 42 may be configured to surround both the refrigerator compartment 22 and the freezer compartment 66 and conceal the mullion 68. The freezer compartment liner 62, the bottom wall 78 of the cabinet 14, and the lower portions 74, 76 of the first and second sidewalls 16, 18 may be operably coupled with a lower trim assembly 186. The lower trim assembly 186 may be any trim assembly, including, for example, an illuminated trim assembly or a non-illuminated trim assembly. The heat loop assembly 42 includes an upper portion 178, a mullion cover 180, and a lower portion 182. The upper portion 178 is configured to align and engage with the trim assembly 10 of the refrigerator compartment 22, and the lower portion 182 is configured to align with and engage with the lower trim assembly 186. The mullion cover 180 extends between the upper and lower portions 178, 182 and is configured to cover the mullion 68. In various examples, the mullion cover 180 may guide the heat loop 48 along the mullion 68. It is contemplated that any number of heat loops 48 may be positioned on or supported by the heat loop cover 44 without departing from the scope of the present disclosure.

The heat loop cover 44 includes a first side 170 configured as a side portion and a second side 172 configured as a forward portion. The first side 170 is configured to be substantially flush with the light housing 32 when assembled. When the heat loop assembly 42 is coupled with the trim assembly 10, the first side 170 is positioned over the forward extension 118 of the light housing 32 and is at least partially positioned over the first receiving portion 90 of the light housing 32. In other words, the first side 170 is substantially flush with a surface of the light housing 32.

The second side 172 of the heat loop cover 44 is configured to wrap around a front of the trim assembly 10 to at least partially cover the trim breaker member 24. The second side 172 is further configured to enclose or cover the heat loop receiving channel 46 defined by the trim assembly 10. A retention hook 174 extends from an end of the second side 172. When the heat loop assembly 42 is coupled with the trim assembly 10, the retention hook 174 is configured to engage with the retention arm 150 of the trim breaker member 24. For example, as illustrated, the retention hook 174 of the heat loop cover 44 may be engaged with the retention feature 152 of the retention arm 150 to couple the heat loop cover 44 with the trim assembly 10.

The second side 172 of the heat loop cover 44 may further be configured to support and/or retain the heat loop 48. For example, as illustrated in FIG. 6, the second side 172 may include a plurality of clips 190 extending along an inner surface of the second side 172. The plurality of clips 190 may be interspaced along the second side 172. The plurality of clips 190 are configured to snap over the heat loop 48 such that the heat loop 48 is coupled with and is guided along the second side 172 of the heat loop cover 44. The plurality of clips 190 may be equally or unequally spaced along the second side 172 and may include any number of clips without departing from the scope of the present disclosure. It is also contemplated that any fastener configured to retain the heat loop 48 on the second side 172 may be used with or in lieu of the plurality of clips 190.

When the heat loop cover 44 is coupled with the trim assembly 10, the heat loop 48 is positioned within the heat loop receiving channel 46. The heat loop 48 is spaced apart from the trim breaker member 24 and the light housing 32. The heat loop 48 may be positioned to guide heat away from the light source 38 when the light source 38 is actuated to illuminate the cabinet 14 and prevent overheating of the cabinet 14 and/or the light source 38.

According to one aspect, a trim assembly for an appliance includes a cabinet having first and second opposing sidewalls and a top wall. The cabinet defines a compartment. A trim breaker member extends continuously along a forward edge of the first and second opposing sidewalls and the top wall. A light housing is positioned rearward of the trim breaker member. The light housing defines a first channel. A lens extends between the trim breaker member and the light housing. The lens is positioned at least partially within the compartment. A light source is positioned within the first channel and is configured to direct light through the lens into the compartment. A heat loop assembly is operably coupled with the trim breaker member. The heat loop assembly includes a cover operably coupled with the trim breaker member and at least partially defining a second channel. A heat loop is positioned within the second channel and is supported by the cover.

According to another aspect, a first channel includes an open end configured to be covered by a lens.

According to another aspect, a trim breaker member includes a retention arm configured to be operably coupled with a cover.

According to another aspect, a cover includes a forward portion and a side portion. The side portion is positioned substantially aligned with an outer surface of a light housing.

According to another aspect, a trim assembly extends along a bottom wall of a cabinet.

According to another aspect, a light source includes a light guide that extends continuously along a trim breaker member.

According to another aspect, a trim assembly for an appliance includes a trim breaker member extending continuously along a forward edge of first and second opposing sidewalls and a top wall of an appliance cabinet. A light housing is positioned rearward of the trim breaker member. The light housing defines a light source channel. A lens extends between the trim breaker member and the light housing. A light source is positioned within the light source channel. The lens is configured to direct light into a cavity defined by the appliance cabinet.

According to another aspect, a trim assembly includes a heat loop cover that has a forward portion and a side portion. The heat loop cover is operably coupled with the trim breaker member.

According to another aspect, a trim assembly includes a heat loop operably coupled with a heat loop cover. The heat loop is configured to be at least partially received within a receiving channel defined by a trim breaker member.

According to another aspect, a trim breaker member includes a retention arm configured to be engaged with a heat loop cover.

According to another aspect, a light source is configured to illuminate continuously along a forward edge of first and second opposing sidewalls and a top wall.

According to another aspect, an appliance cabinet includes a liner. A light housing is at least partially coupled with each of the cabinet and the liner.

According to another aspect, an appliance has an illuminated trim assembly that includes an appliance cabinet having first and second sidewalls and a top wall. The appliance cabinet defines a compartment. A trim breaker member extends along a forward edge of the first and second sidewalls and the top wall. A light housing is positioned rearward of the trim breaker member and defines a light source channel. The light source channel has an open end proximate the compartment. A lens extends between the trim breaker member and the light housing. The lens is positioned to separate the light source channel from the compartment. A light source is positioned within the light source channel and is configured to direct light through the lens into the compartment.

According to another aspect, a trim breaker member defines a heat loop receiving channel.

According to another aspect, an appliance includes a heat loop assembly operably coupled with a trim breaker member. The heat loop assembly includes a cover operably coupled with the trim breaker member. A heat loop is supported by the cover and at least partially received by a heat loop receiving channel.

According to another aspect, a heat loop receiving channel is positioned forward of a light source channel.

According to another aspect, a light source directs light through a lens at corners formed where first and second sidewalls abut a top wall.

According to another aspect, a light source is a single light source operably coupled with a light guide. The light guide is positioned within a light source channel.

According to another aspect, a light source channel is configured as a light guide to direct light from a light source.

According to another aspect, a lens includes optics configured to direct the light from the light source into the compartment.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A trim assembly for an appliance, comprising:

a cabinet having first and second opposing sidewalls and a top wall, wherein the cabinet defines a compartment;

a trim breaker member extending continuously along a forward edge of the first and second opposing sidewalls and the top wall;

a light housing positioned rearward of the trim breaker member, wherein the light housing defines a first channel;

a lens extending between the trim breaker member and the light housing, wherein the lens is positioned at least partially within the compartment;

a light source positioned within the first channel and configured to direct light through the lens into the compartment, wherein the light source is configured to illuminate continuously along the forward edge of the first and second opposing sidewalls and the top wall; and a heat loop assembly operably coupled with the trim breaker member, the heat loop assembly including:

a cover operably coupled with the trim breaker member and at least partially defining a second channel; and a heat loop positioned within the second channel and supported by the cover.

2. The trim assembly of claim 1, wherein the first channel includes an open end configured to be covered by the lens.

3. The trim assembly of claim 1, wherein the trim breaker member includes a retention arm configured to be operably coupled with the cover.

4. The trim assembly of claim 1, wherein the cover includes a forward portion and a side portion, the side portion positioned substantially aligned with an outer surface of the light housing.

5. The trim assembly of claim 4, wherein the trim assembly extends along a bottom wall of the cabinet.

6. The trim assembly of claim 1, wherein the light source includes a light guide that extends continuously along the trim breaker member.

7. The appliance of claim 1, wherein the light source directs light through the lens at corners formed where the first and second sidewalls abut the top wall.

8. A trim assembly for an appliance, comprising:

a trim breaker member extending continuously along a forward edge of first and second opposing sidewalls and a top wall of an appliance cabinet;

a light housing positioned rearward of the trim breaker member, wherein the light housing defines a light source channel;

a lens extending between the trim breaker member and the light housing;

a light source positioned within the light source channel, wherein the lens is configured to direct light into a cavity defined by the appliance cabinet, and further wherein the light source is configured to illuminate continuously along the forward edge of the first and second opposing sidewalls and the top wall.

9. The trim assembly of claim 8, further comprising:

a heat loop cover having a forward portion and a side portion, wherein the heat loop cover is operably coupled with the trim breaker member.

10. The trim assembly of claim 9, further comprising:

a heat loop operably coupled with the heat loop cover and configured to be at least partially received within a receiving channel defined by the trim breaker member.

11. The trim assembly of claim 10, wherein the trim breaker member includes a retention arm configured to be engaged with the heat loop cover.

12. The trim assembly of claim 8, wherein the appliance cabinet includes a liner, and further wherein the light housing is at least partially coupled with each of the cabinet and the liner.

13. An appliance having an illuminated trim assembly, comprising:

an appliance cabinet having first and second sidewalls and a top wall, the appliance cabinet defining a compartment;

a trim breaker member extending along a forward edge of the first and second sidewalls and the top wall;

a light housing positioned rearward of the trim breaker member and defining a light source channel, the light source channel having an open end proximate the compartment;

a lens extending between the trim breaker member and the light housing, wherein the lens is positioned to separate the light source channel from the compartment; and a light source positioned within the light source channel and configured to direct light through the lens into the compartment and illuminate continuously along the forward edge of the first and second opposing sidewalls and the top wall.

14. The appliance of claim 13, wherein the trim breaker member defines a heat loop receiving channel.

15. The appliance of claim 14, further comprising:

a heat loop assembly operably coupled with the trim breaker member, the heat loop assembly including:

a cover operably coupled with the trim breaker member; and a heat loop supported by the cover and at least partially received by the heat loop receiving channel.

16. The appliance of claim 14, wherein the heat loop receiving channel is positioned forward of the light source channel.

17. The appliance of claim 13, wherein the light source directs light through the lens at corners formed where the first and second sidewalls abut the top wall.

18. The appliance of claim 13, wherein the light source is a single light source operably coupled with a light guide, and further wherein the light guide is positioned within the light source channel.

19. The appliance of claim 13, wherein the light source channel is configured as a light guide to direct light from the light source.

20. The appliance of claim 13, wherein the lens includes optics configured to direct the light from the light source into the compartment.

* * * * *